US010974506B2

(12) United States Patent
Smith et al.

(10) Patent No.: US 10,974,506 B2
(45) Date of Patent: Apr. 13, 2021

(54) CHARGE ELECTRODE

(71) Applicant: Videojet Technologies Inc., Wood Dale, IL (US)

(72) Inventors: Robert Smith, Thrapston (GB); Salhadin Omer, Cambridge (GB)

(73) Assignee: VIDEOJET TECHNOLOGIES INC., Wood Dale, IL (US)

( * ) Notice: Subject to any disclaimer, the term of this patent is extended or adjusted under 35 U.S.C. 154(b) by 0 days.

(21) Appl. No.: 16/607,909

(22) PCT Filed: Apr. 25, 2018

(86) PCT No.: PCT/US2018/029369
§ 371 (c)(1),
(2) Date: Oct. 24, 2019

(87) PCT Pub. No.: WO2018/200678
PCT Pub. Date: Nov. 1, 2018

(65) Prior Publication Data

US 2020/0180309 A1 Jun. 11, 2020

(30) Foreign Application Priority Data

Apr. 25, 2017 (GB) ..... 1706562.4

(51) Int. Cl.

| | |
|---|---|
| ***B41J 2/085*** | (2006.01) |
| ***B41J 2/09*** | (2006.01) |
| ***B41J 2/175*** | (2006.01) |
| ***B41J 2/185*** | (2006.01) |

(52) U.S. Cl.
CPC ..... *B41J 2/085* (2013.01); *B41J 2/09* (2013.01); *B41J 2/175* (2013.01); *B41J 2/185* (2013.01); *B41J 2002/1853* (2013.01)

(58) Field of Classification Search
CPC ..... B41J 2/09; B41J 2/175; B41J 2/185; B41J 2/085; B41J 2002/1853
See application file for complete search history.

(56) References Cited

FOREIGN PATENT DOCUMENTS

| | | |
|---|---|---|
| EP | 0293496 A1 | 12/1988 |
| GB | 1477034 A | 6/1977 |
| WO | 2015187983 A2 | 12/2015 |

OTHER PUBLICATIONS

PCT/US2018/029369 International Search Report and Written Opinion, dated Oct. 7, 2018, 9 pages.

*Primary Examiner* — Lamson D Nguyen
(74) *Attorney, Agent, or Firm* — Wolter Van Dyke Davis, PLLC; Robert L. Wolter

(57) ABSTRACT

There is provided a charge electrode for charging ink droplets for continuous ink jet printing. The charge electrode has a generally cylindrical main body defining a generally cylindrical passage for the ink droplets, said passage extending along a travel axis that represents, in use, the position of an ink jet in ingress to the electrode and a direction of travel of the ink droplets once these have detached from the ink jet. The charge electrode comprises two distinct axially disposed regions: a first region for charging the droplets as required; and, a second region for screening the charged droplets from any electric fields which could undesirably affect the trajectory of the ink jet and/or the droplets. The second region may fully surround at least a portion of the travel axis. The invention therefore provides improved screening for the ink jet and/or the droplets. This may in turn enable better control of the charge applied to the charged droplets, and/or of their travel trajectory.

29 Claims, 4 Drawing Sheets

CHARGE ELECTRODE

The present invention relates to charge electrodes. In particular, the present invention relates to charge electrodes for continuous ink jet printers.

The present invention also relates to a continuous ink jet printhead; to apparatus comprising such electrodes, such as a printhead or a continuous ink jet printer; and, to a method of printing.

Continuous ink jet printing is an established technique for marking rapidly moveable substrates in industrial environments such as production lines. One or more continuous jets of ink are emitted in the form of tiny filaments by corresponding one or more printing nozzles located on a printhead. The printhead is in fluid communication with an ink reservoir which contains ink of a suitable composition. In multi-jet applications a plurality of nozzles and/or orifices, each orifice corresponding to an ink jet, may be provided. In binary array printers, the ink jets are arranged as an array.

Vibration is applied to the one or more ink jets typically by one or more piezoelectric elements suitably disposed in, and coupled with, parts of the printhead and/or the nozzles individually. In use, the ink jets are caused by the vibration to break off and form discrete droplets of ink which may be selectively charged so that the charged droplets can be deflected on their travel to the printed substrate by an electric deflection field generated by a pair of deflection plates. In typical arrangements, the deflected drops are printed onto the substrate at a location that depends on the charge carried by the charged droplets, and the uncharged droplets are collected in a gutter.

It is thus important to charge only the ink droplets that are intended to be printed. Further, it is also important that the to-be-printed droplets be charged consistently and reliably with the required amount of charge. A charge electrode is usually provided for this purpose, and is generally located immediately downstream from the nozzle.

Due to various factors such as variations in the ink composition, nozzle pressure, temperature and other work conditions, the location at which the droplets form along the continuous ink filament may vary. Likewise, in the time domain, the time instant at which each droplet forms may vary. It is important to predict first, and then to measure, where and when the droplets detach because this information in turn enables correct charge signals to be applied to the charge electrode to charge the required droplets. If the electric field is applied too early, that is before the droplets detach from the ink jet, the charge temporarily induced by the charge electrode on the droplet which is about to form dissipates in the ink jet before the droplet has detached. If the electric field is applied too late, the correct charge may no longer be able to be induced on the detached droplet, or the droplet may not be charged at all. Between these limiting cases, it is possible to have a mismatch between the charge actually induced on any ink drop and the required charge.

One or more sensors are also usually provided in the printhead arrangement to detect parameters relating to the formation of the droplets, and particularly of the charged droplets, and measure, as required, their time of flight, size, speed or charge. Some of these detected parameters are referred to as the phase data (or phase parameters) since they allow to describe the phase relationship (eg the time delay) between the drop formation and a reference signal such as the modulation signal that drives the piezoelectric elements. At least some of these sensors may accordingly be referred to as phase sensors.

The phase information is suitably used to charge the droplets. However, the current designs of charge electrodes are rather basic, and inadequate or inaccurate selective charging of the droplets may still occur. Further, the intended trajectory of the charged droplets through the charge electrodes or in exit therefrom may be deflected by the charge and/or deflection electric fields, or by any stray neighbouring electric fields. The present invention addresses these shortages and provides an improved charge electrode for continuous ink jet printing compared to the prior art.

According to an aspect of the present invention, there is therefore provided a charge electrode for continuous ink jet printers, said electrode defining a passage for forming and shielding charged ink droplets, said passage extending along a travel axis that represents, in use, the position of an ink jet that enters the electrode and from which ink droplets detach inside the electrode, and a direction of travel of the ink droplets before they exit the electrode, wherein the electrode comprises first and second axially disposed regions, wherein the first region is configured to induce a charge on selected ink droplets by capacitive coupling with the ink jet, and the second region is configured to shield the charged ink droplets by surrounding at least a segment of said travel axis, wherein the charge electrode has an axial extension measuring 5 millimetres or longer.

In preferred embodiments, the charge electrode has an elongated shape in the direction of said travel axis.

In departing from the prior art, embodiments of the present invention accordingly provide a charge electrode for continuous ink jet printers, wherein the ink jet and/or the ink droplets are tunneled through the charge electrode for at least part of their path through the charge electrode. It will be understood, however, that configurations where the drops are tunneled into the charge electrode for their whole path through the charge electrode are also included.

The first and second axially disposed regions may be structured and/or configured to be generally different one compared to the other.

In preferred embodiments, the first axially disposed region may be better structured and/or configured relative to the second axially disposed region to induce said charge on the charged ink droplets. For example, in preferred embodiments said passage may be generally narrower through said first region than said second region.

In preferred embodiments, the second axially disposed region may be better structured and/or configured relative to the first axially disposed region to shield the charged droplets. For example, in preferred embodiments said second region may be axially longer than said first region.

The first axially disposed region may be configured to induce said charge on said selected ink droplets for the selected ink droplets to be deflected by one or more deflection plates for printing onto a moving substrate at predetermined positions.

The charge electrode may be generally tubular. Embodiments of the present invention may thus provide a generally tubular charge electrode for continuous ink jet printers, wherein the ink jet and the ink droplets are tunneled through the generally tubular charge electrode for charging first, and to be shielded thereafter, or wherein at least the charged ink droplets are tunneled through the generally tubular charge electrode to be shielded after these droplets have been charged, for at least part of their path across the tubular charge electrode.

The invention thus provides improved screening to the ink jet entering the charge electrode and/or the charged ink droplets, such as for example improved electromagnetic screening, and, accordingly, may enable better control of the charge applied to the charged droplets when they break off from the ink filament or of their intended trajectory.

In preferred embodiments, the charge electrode fully surrounds said segment of the travel axis. It will be understood that for the invention to subsist, however, it is not required that the charge electrode fully surrounds, ie uninterruptedly and without gaps, the travel axis along that segment, for example around a whole 360° angle (with reference to a plane perpendicular to this axis). It is sufficient that the charge electrode substantially surround the referenced travel axis segment so as to substantially encircle the direction of travel of the charged ink droplets and thus provide improved screening to the charged ink droplets transiting in the electrode.

Charge electrode designs having at least a section of the charge electrode that, as defined above, substantially wraps around the ink jet droplets along said segment are therefore considered to be within the scope of the present invention.

Preferred embodiments of charge electrode may thus feature a continuous or uninterrupted second region of the charge electrode that fully surrounds the ink droplets around their direction of travel. By contrast, currently used designs of charge electrodes instead always include a substantial circumferential discontinuity, or gap, around the travel axis of the ink droplets and accordingly may not adequately screen the charged drops. These designs are, of course, excluded from the scope of the appended claims.

Preferably, the charge electrode comprises a generally cylindrical body which may: increase or optimise said screening effect; at least facilitate the installation of the charge electrode; or, provide a compact or alternative design of charge electrode.

Said generally cylindrical body may define a cylinder axis. Said cylinder axis may at least partially overlap with said travel axis. In preferred embodiments, however, the referenced travel axis defined by the passage of the charge electrode extends over said cylinder axis. In preferred embodiments, referred to as coaxial charge electrodes, the travel axis and the cylinder axis coincide.

Preferably, the charge electrode is provided with a viewing aperture for observing and thus confirming the formation of the ink droplets. Although this feature may represent a desired optional feature (depending on the application), the viewing aperture may also be considered to be a detraction to the present invention in that the viewing aperture will, to some extent, reduce the required screening effect in connection with the charged ink droplets. The viewing aperture may thus extend only part-way along the charge electrode, for example in the direction of travel of the drops, that is not for the whole length of the charge electrode, as instead is the case in the prior art.

In embodiments of the present invention, the second region of the charge electrode that surrounds said segment or portion of the travel axis of the charged drops may define an outlet aperture provided at an outlet end (or distal end) of the charge electrode. Said outlet end (or distal end) may be provided, for example, to one side of the portion of electrode provided with said viewing aperture.

Said viewing aperture may be provided on a side of said generally cylindrical body of the charge electrode. The viewing aperture may have an elongated shape that extends in the direction of the travel and/or cylinder axes, and may have a generally rectangular shape, optionally with rounded ends.

Two ends of the charge electrode may be defined on either side of the viewing aperture. Said two ends may be one an inlet end (or proximal end) of the charge electrode, and the other end may be said outlet or distal end.

The generally cylindrical body may comprise an outer stepped profile. The outer stepped profile may define a cylindrical length of increased diameter with respect to the rest of the cylindrical body. This cylindrical length may, for example, be provided proximally on said inlet end and thus be used to immediately identify the inlet end of the charge electrode. The generally cylindrical body may comprise said outlet aperture at an opposite end of the charge electrode (this would be the outlet end of this embodiment of charge electrode).

The inlet end or, in certain embodiments, said cylindrical length with increased diameter may be provided with an inlet aperture for the inkjet. The first axial region may comprise said cylindrical length. In some embodiments, the first axial region comprises said inlet end.

The inlet aperture may be smaller compared to the outlet aperture. The smaller size of the inlet aperture and the larger size of the outlet aperture may together facilitate a proper alignment of the charge electrode with the ink jet. A user may thus only be required to adequately align the inlet end of the charge electrode, and in particular its inlet aperture, with the inkjet, to observe the charged droplets being successfully emitted from the outlet aperture of charged electrode, on their intended trajectory. However, the vice versa is also possible, albeit this solution would be less desirable since the alignment of the electrode with the ink filament could then be more difficult.

It will be understood that the larger size of the outlet aperture compared to the inlet aperture (and/or, in some embodiments, the larger size of the electrode passage in correspondence with the second axially disposed shielding region of the charge electrode with respect to the size of the electrode passage in correspondence with the first axially disposed charging region of the electrode) may partially be to the detriment of the invention, since the larger size of the outlet aperture may result into additional (thus unwanted) exposure of the charged droplets to the aforementioned electric fields. However, this potential set back can be remedied, in accordance with the present aspect of the invention, by allowing for relatively longer charge electrodes, any added length of the charge electrode contributing to reduce the above exposure for any given outlet aperture size.

In any case, axial extensions of the charge electrode equal to or greater than 5 millimetres are considered as potentially providing adequate space for usefully screening or shielding the charged ink droplets while the charge electrode is simultaneously able to charge selected droplets before said screening or shielding takes palace.

The inlet and/or the outlet apertures may be generally circular, generally elliptical, elongated or ovoidal in shape. In preferred embodiments, the inlet aperture is an ellipse, an ovoid or an elongated rectangular aperture with rounded edges and defines first (major) and second (minor) cross-sectional symmetry axes (henceforth referred to as cross-sectional symmetry "diameters" so as not to confuse these features with the axis of the passage for the ink jet and the charged droplets or of the generally cylindrical body) one longer than the other. The outlet aperture may be circular, and have its diameter greater than the major diameter of the inlet aperture, or greater than the diameter of the inlet aperture if this is circular too. In preferred embodiments, the outlet aperture is about twice the size of the inlet aperture. In preferred embodiments the major cross-sectional symmetry diameter may be about twice the length of the smaller cross-section symmetry diameter.

Preferably, the passage is also generally cylindrical. The generally cylindrical body and the generally cylindrical passage may be coaxial or substantially coaxial. Any diameter measured inside the passage of the charge electrode may accordingly be smaller than any diameter measured on the generally cylindrical body of the charge electrode.

The passage may comprise a step defining an internally stepped profile for the passage. Accordingly, the passage may be divided into a first portion having a first diameter and cross section, and a second portion having a second diameter and cross section greater than the first diameter and cross section respectively. These portions may define, or at least allow easy identification of, the aforementioned first and second regions of the electrode. The first axial region of the charge electrode may comprise the first portion of the passage, or it can be identified and/or defined by said first portion of the passage. The second axial region of the charge electrode may comprise said second portion of the passage, or it can be identified and/or defined by said second portion.

In preferred embodiments, the outlet aperture has a diameter which is approximately half that of the generally cylindrical body of the charge electrode at the outlet end.

Preferably, the charge electrode comprises a mounting feature for mounting the charge electrode on a printhead. The mounting feature may be in the form of a flat provided on the generally cylindrical body of the charge electrode. This flat may in addition provide spring-loaded electrical contact for the charge electrode. However, it will be appreciated that electrical contact may be provided according to alternative arrangements. In preferred embodiments, said flat is located on the outlet end and/or on the second axial region of the charge electrode, and may extend part-way along the length of the generally cylindrical body, parallel to the travel and/or cylinder and/or passage axes. It will be understood, however, that other mounting features are also possible.

Preferably, the charge electrode comprises an orientation feature for enabling or facilitating orientation or registration in place of the charge electrode when this is mounted on a printhead. This may prevent incorrect installation of the charge electrode. The orientation feature may be located adjacent the viewing aperture and may extend generally in the same direction, for example parallel to the travel axis of the ink drops. In preferred embodiments, the mounting feature and the orientation feature are one and the same. In preferred embodiments, the mounting and orientation feature may be provided by the flat described hereinabove. The mounting and/or orientation feature and the viewing aperture may be provided on a same side of the charge electrode. In cylindrical arrangements, the mounting and/or orientation feature and the viewing aperture may be provided at corresponding circumferential locations with respect to a common angular reference (for example, at 0 degrees or at 180 degrees).

Preferably, the length of the second region of the charge electrode is greater than 2 mm. This may advantageously provide additional and thus enhanced shielding or screening. In departing from the prior art, embodiments of the present invention may therefore provide longer or elongated charge electrodes in the direction of travel of the ink drops. It will be understood that by 'length', in the present paragraph we refer to the space traveled by the charged drops within the electrode.

Preferably, the charge electrode may be longer than 6 mm. Preferably, the charge electrode may be longer than 7 mm. Preferably, the charge electrode may be longer than 8 mm. Preferably, the charge electrode may be longer than 9 mm. Preferably, the charge electrode may be longer than 10 mm. In preferred embodiments, these increments correspond to increments of the length of the second axial region of the charge electrode.

The length of the viewing aperture may be up to a maximum of 5 mm. This is considered adequate for at least the majority of the applications. It is desirable, however, to minimize the size of the viewing aperture for the reasons explained above. Of course, it will also be appreciated that the length of the viewing aperture may be selected so as to be sufficiently long to allow for convenient observation of a range of break-off point locations. The length of the viewing aperture may thus be between 1 and 5 mm, and may preferably be about 3 to 3.5 millimetres.

The overall length of the charge electrode may also be bound by an upper limit. However, this will depend on the application and will thus not be discussed in detail in the present patent specification. Generally, however, such upper limit (ie the maximum electrode length) will be dictated by the requirement of avoiding longer-than-necessary droplet flights, between the instant a droplet is formed to the instant the droplet is deposited on the substrate. Aerodynamic resistance and potential electrical interaction between charged neighbouring drops may otherwise mean that printing may become difficult or unsatisfactory.

The above considerations are balanced by the contrasting requirements to provide adequate charging facilities for the droplets, and to deflect the charged droplet trajectories during flight for printing. The present invention, as it will be apparent, arises within the context of charging the droplets and controlling their trajectory at and immediately after charging has occurred and thus relates to the design, shape and/or size of the charge electrode but not its maximum length, which may instead be determined based on other considerations.

The electrode can be removably or adjustably mounted onto a printhead deck. Alternatively, the electrode may be mounted within a monolithic printhead deck, the monolithic printhead deck being a single piece arranged to support at least the nozzle and the charge electrode.

According to another aspect of the present invention there is provided apparatus comprising a charge electrode as described herein in connection with the above aspect of the present invention. Said apparatus may for example be a part for a printhead. This may be preassembled, or may be provided as a kit for assembly.

According to another aspect of the present invention, there is provided a continuous ink jet printhead comprising:

- a nozzle for producing a continuous ink jet and ink droplets detached from said continuous ink jet;
- a charge electrode as described herein in conjunction with the previous aspect of the invention;
- one or more deflection plates for deflecting any charged ink jet droplets for printing on a moving substrate associated with the printhead; and
- a gutter for recirculating any uncharged ink droplets.

The nozzle may be configured to emit the continuous ink jet at a velocity V. The velocity V may be within a range of velocities from a minimum velocity Vmin (this may be for example 18 meters per second—m/s) to a maximum velocity Vmax (this may be for example 25 meters per second).

The printhead may be arranged to form the ink jet droplets at a frequency F. The frequency F may be within a range of frequencies from a minimum frequency Fmin (this may be for example 64 kHz) to a maximum frequency Fmax (this may be for example 128 kHz).

The ink droplets may accordingly be generated at a droplet pitch DP=V/F. Accordingly, the droplet pitch DP may vary between a minimum droplet pitch DPmin=Vmin/Fmax (this may be for example approximately 140 microns) and a maximum droplet pitch DPmax=Vmax/Fmin (this may be for example approximately 390 microns).

In preferred embodiments, the length of the second region may be greater than 15 minimum droplet pitches DPmin (corresponding in the examples provided above to 2.1 mm). Thus, in these preferred embodiments a minimum of 16 potentially charged drops may be simultaneously shielded by the second region of the charge electrode.

The length of the charge electrode may be greater than 15 maximum droplet pitches DPmax (corresponding in the examples provided above to about 5.8 mm). This may advantageously accommodate a greater variation of the location of drop formation along the ink jet.

In preferred embodiments, the length of the charge electrode may be less than 70 maximum droplet pitches DPmax (corresponding in the examples provided above to 27.3 mm). The length of the charge electrode may be less than 70 minimum droplet pitched DPmin (corresponding in the examples provided above to 9.8 mm). This may advantageously reduce the time of flight of the droplets.

According to another aspect of the present invention there is provided apparatus comprising a continuous ink jet printhead as described herein in connection with the above aspect of the present invention. Said apparatus may for example be a continuous ink jet printer.

According to another aspect of the present invention there is provided a method of continuous ink jet printing, the method comprising:

- generating a continuous ink jet;
- forming a plurality of ink droplets from said continuous ink jet;
- using a charge electrode as described herein in conjunction with the above respective aspect of the present invention, selectively charging the ink droplets for printing on a moving substrate;
- deflecting any charged ink droplets to print them on the moving substrate at predetermined positions.

It will be understood that features described herein or claimed below in connection with any one of the above aspects of the invention may be combined with the feature described in connection with any other described or claimed aspect unless otherwise stated, or where technically impossible to do so.

The invention will now be described purely by way of example in connection with the appended drawings in which.

Figure 3:
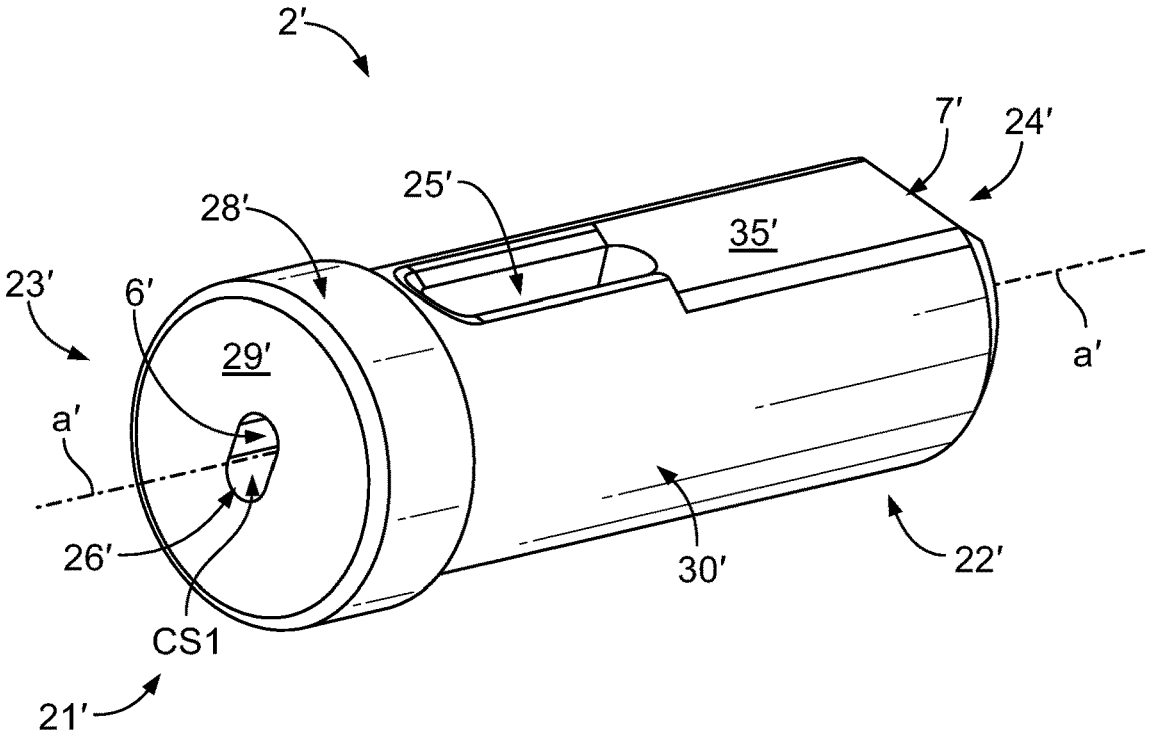
FIG. 3 is a first perspective view of a charge electrode according to an embodiment of the present invention.
Figure 4:
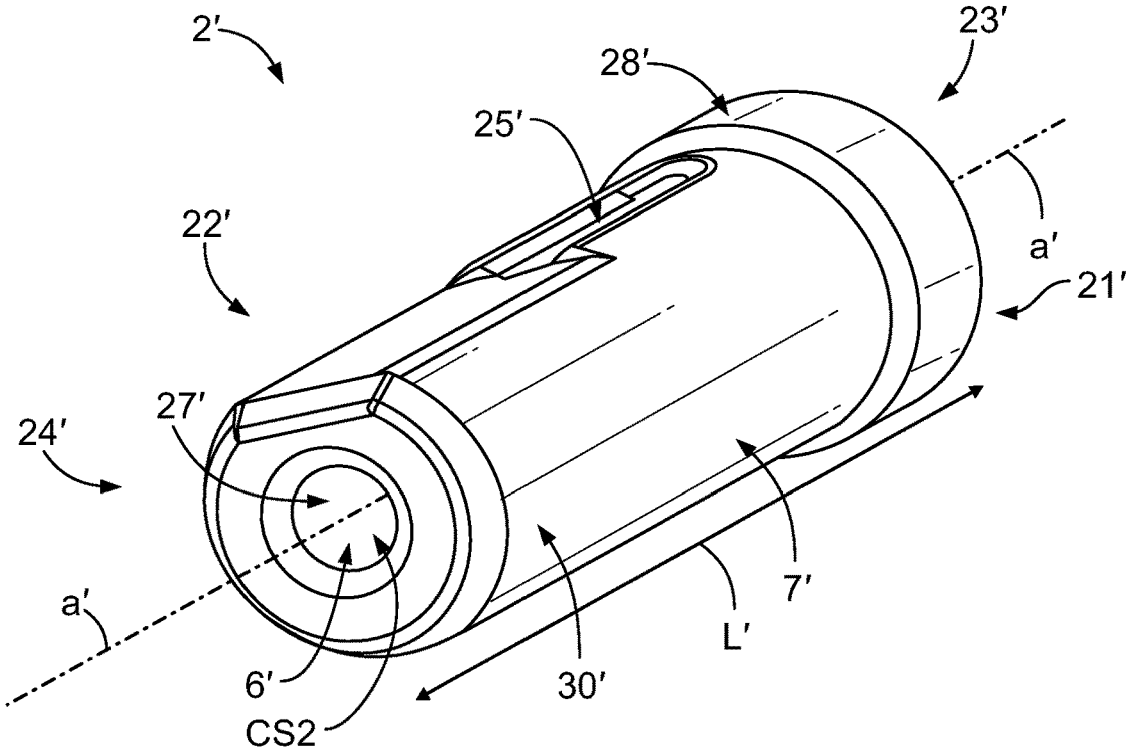
FIG. 4 is a second perspective view of the charge electrode of FIG. 3 viewed from an opposite end.
Figure 7:
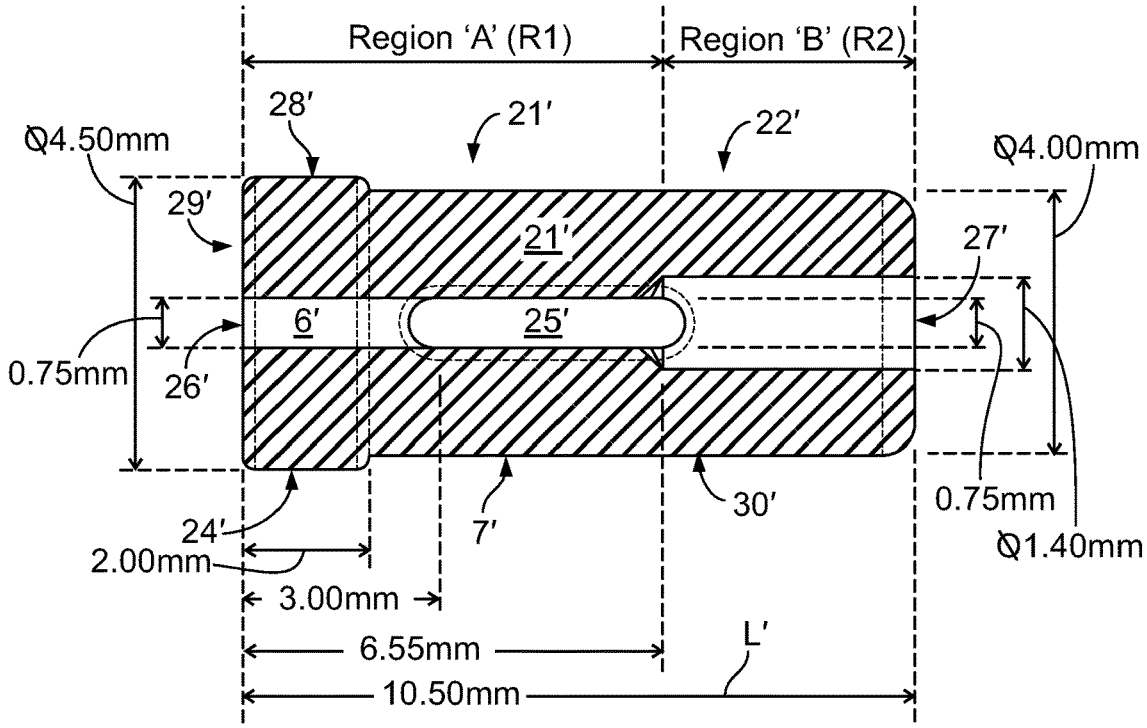
Figure 6A:
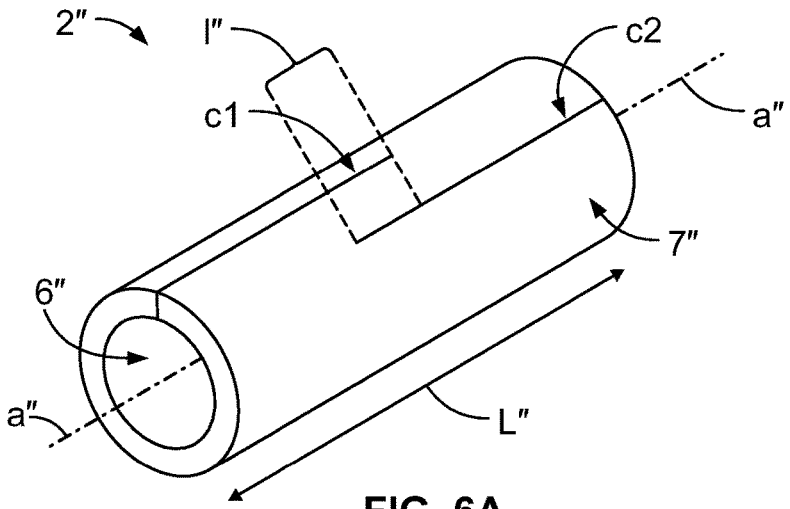
Figure 6B:
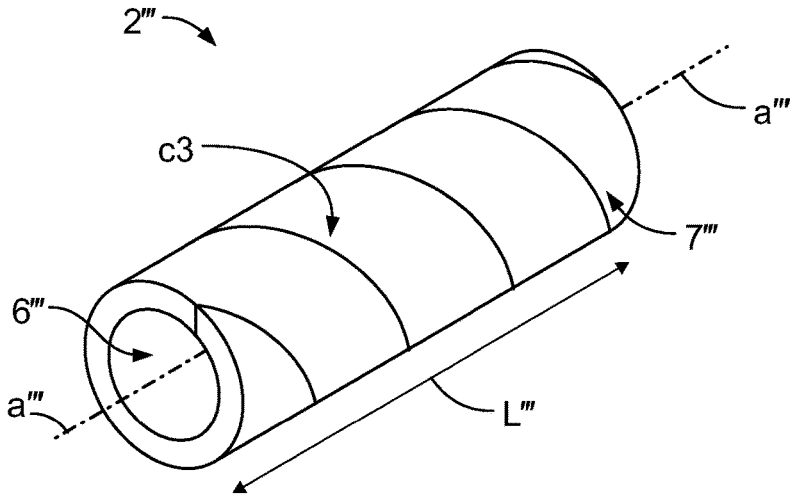
Figure 6C:
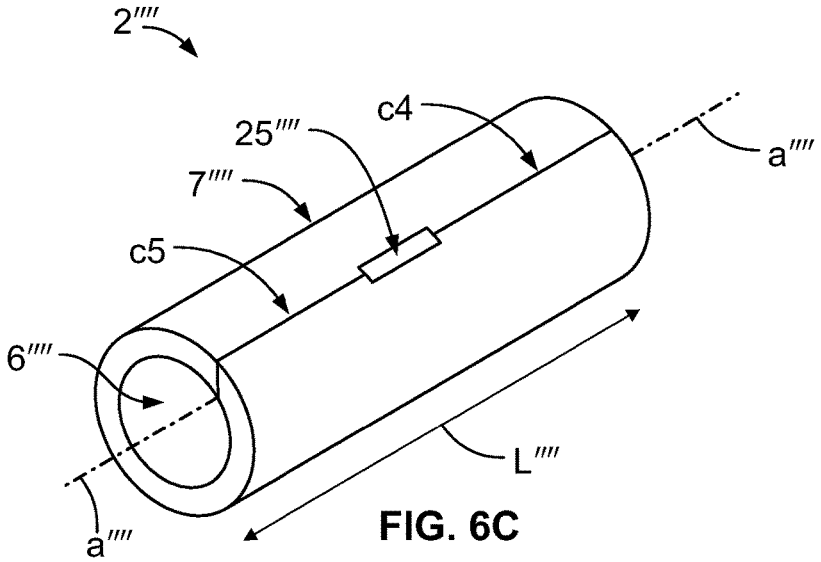

FIG. 6 (which is made up of FIGS. 6*a*, 6*b* and 6*c*) shows alternative embodiments of charge electrodes in accordance with the present invention; and FIG. 7 is a cross-sectional representation of the charge electrode of FIGS. 3 and 4, with most dimensions stated (in millimetres—mm).

Where possible, corresponding features have been labelled below with the same reference numerals. This applies to the prior art charge electrodes and to the described embodiments.

Where possible, indices ', ", ''' and '''' have been used below to identify corresponding features across different embodiments of the invention.

Continuous ink jet printers supply pressurised ink to a printhead drop generator where a continuous stream of ink emanating from a nozzle 1 (shown in FIG. 2) is broken up into individual regular drops by, for example, an oscillating piezoelectric element housed in the drop generator.

Figure 1:
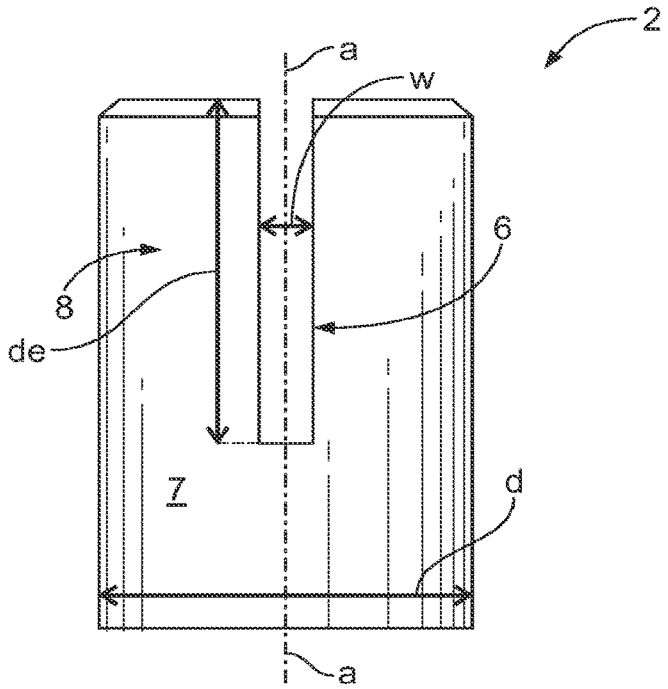
FIG. 1 Prior Art
FIG. 1 is a side view of a portion of a charge electrode of the prior art.
Figure 2:
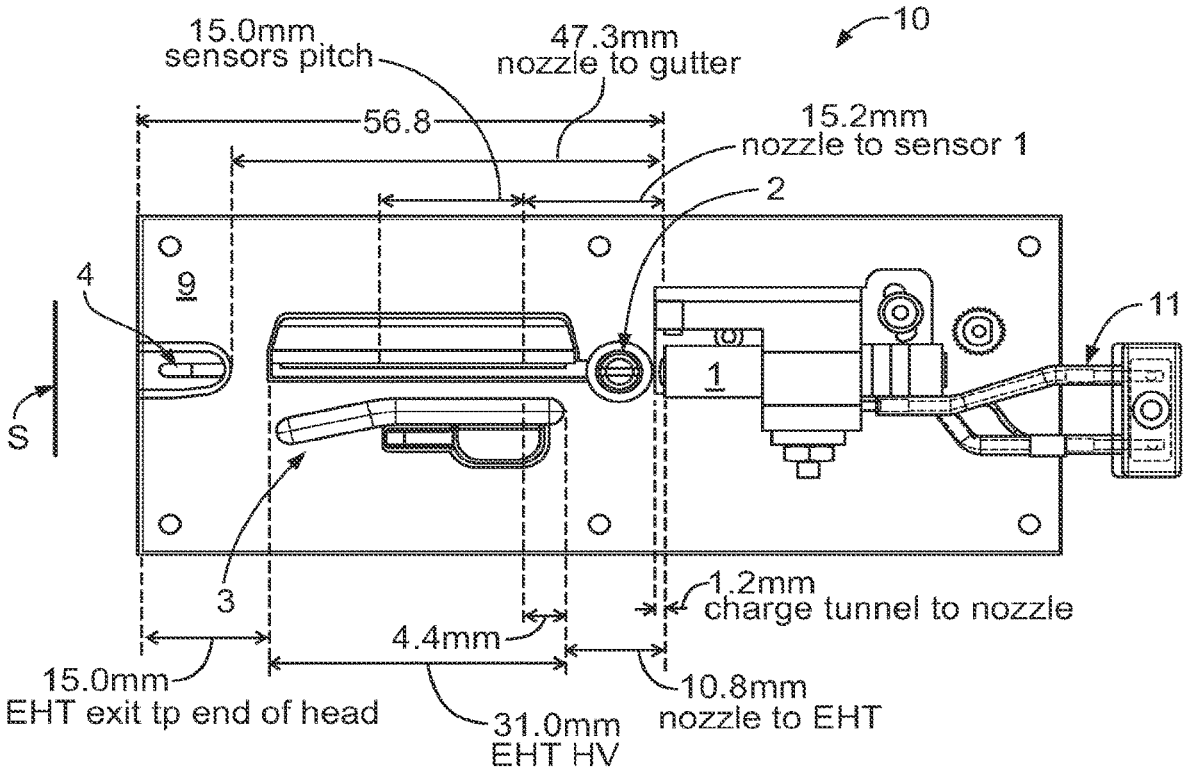
FIG. 2 Prior Art
FIG. 2 is a top view of the deck of a continuous ink jet printhead of the prior art, showing the charge electrode of FIG. 1.

The drops or droplets are directed past a charge electrode 2 where they are selectively and separately given a predetermined charge before passing through a transverse electric field provided across a pair of deflection plates 3. A side view of a charge electrode according to the prior art is shown in FIG. 1, and FIG. 2 shows the arrangement of a printhead 10 also according to the prior art, incorporating the charge electrode of FIG. 1.

Each charged drop is deflected by the field by an amount that is dependent on its charge magnitude before impinging on a substrate S whereas the uncharged drops proceed without deflection and are collected at a gutter 4 from where they are recirculated to the ink supply for reuse.

The charged drops bypass the gutter 4 and hit the substrate S at a position determined by the charge on the drop and the position of the substrate S relative to the printhead.

Typically, the substrate S is moved relative to the printhead 10 in one direction and the drops are deflected in a direction generally perpendicular thereto, although the deflection plates may be oriented at an inclination to the perpendicular to compensate for the speed of the substrate (the movement of the substrate relative to the print head between drops arriving means that a line of drops would otherwise not quite extend perpendicularly to the direction of movement of the substrate). It will be understood that in FIG. 2 (and corresponding FIG. 5) the substrate S travels in a direction perpendicular to the sheet of paper.

In continuous ink jet printing, a character is printed from a matrix comprising a regular array of potential drop positions. Each matrix comprises a plurality of columns (strokes), each being defined by a line comprising a plurality of potential drop positions (e.g. seven) determined by the charge applied to the drops by the charge electrode 2.

Thus each usable drop is charged according to its intended position in the stroke. If a particular drop is not to be used then the drop is not charged and it is captured at the gutter 4 for recirculation. This cycle repeats for all strokes in a matrix and then starts again for the next character matrix.

Ink is delivered under pressure to the printhead 10 by an ink supply system (only part of which is shown in FIG. 2) that is generally housed within a sealed compartment of a cabinet that includes a separate compartment for control circuitry and a user interface panel. The system includes a main pump that draws the ink from a reservoir or tank via a filter and delivers it under pressure to the printhead 10. As ink is consumed the reservoir is refilled as necessary from a replaceable ink cartridge that is releasably connected to the reservoir by a supply conduit. The ink is fed from the reservoir via a flexible delivery conduit 11 to the printhead 10. The unused ink drops captured by the gutter 4 are recirculated to the reservoir via a return conduit (not shown) by a pump (also not shown). The flow of ink in each of these conduits is generally controlled by solenoid valves and/or other like components (also not shown).

As it can be seen from FIGS. 1 and 2, conventional charge electrodes 2 mounted in this kind of ink jet printers are in the form of a slotted cylindrical barrel 7. The barrel 7 typically has a diameter d of a few millimetres, and 6 millimetres in the case of the electrode of FIG. 1. This is consistent with the dimensions provided on FIG. 2. The barrel 7 is mounted on a printhead deck 9 with the axis a of the barrel 7 perpendicular to the front deck surface visible in FIG. 2.

The length of the charge electrode 2 in the direction of travel of the ink drops corresponds therefore to 6 millimetres. This is an upper limit in the prior art, with most conventional charge electrodes measuring 5 millimetres or under. This limit is dictated by the requirement of providing a compact printhead 10 while allowing a sufficient gap between the charge electrode 2 and the deflection plates 3.

While the charge electrode 2 is supplied with a maximum voltage of around 250V to charge the drops, the deflection plates are supplied with much higher voltages known as Extra High Tension (EHT), for example between 6,000-8,000V, to deflect the charged drops.

The distance between the deflection plates 3 and the charge electrode 2 in the direction of travel of the ink drops is such that, as it will be apparent, the deflection plates 3 and the charge electrode 2 do not become electrically bridged.

As it can be seen in FIG. 1, a slot 6 having a width w of less than 1 millimetre is cut halfway through an upper end 8 of the cylindrical barrel 7, on a plane that contains the axis a of the cylinder 7. The slot 6 extends axially downwards for a depth de which is about the size of the diameter d of the barrel 7 (ie about 6 millimetres).

The charge electrode 2 is disposed on the printhead deck 9 as shown in FIG. 2, ie such that the ink drops transit through the head 8 of the barrel 7 across the slot 6 in a direction substantially perpendicular to the axis a of the barrel 7.

As described above, the arrangement is such that the ink drops are broken from a continuous ink jet ejected by the nozzle 1 within the charge electrode. Therefore, the drops can at most transit within the charge electrode for a distance equal to the diameter of the charge electrode 2, ie 6 millimetres in the present case. Such a distance will normally, however, be less than 6 millimetres since the drops will form at a location some way through the electrode It is important that the charge electrode 2 be driven by appropriate circuitry (not shown) such that the required electric field is precisely generated by the charge electrode 2 when a drop is about to break off at this internal location.

The present invention arises from the appreciation by the inventors that the current designs of charge electrode 2 may not adequately protect the continuous ink jet entering the charge electrode 2 and/or the charge ink drops formed therein, or that in any event it is possible to improve the charge electrode designs of the prior art.

In particular, the present invention arises from the appreciation that it may be possible to improve the shielding or screening effect of the charge electrode 2 with respect to any polluting or stray electric fields such as that originated by the deflection plates 3 at the moment of formation of any charged drops and their initial travel stages.

Another source of undesired electric field contamination may be any electronic circuitry mounted on the rear side of the deck 9. Otherwise, the printhead 10 may be close to foreign electronic equipment and this equipment may constitute a source of undesired electric fields.

In relation to any selectively charged ink droplets flying through the charge electrode 2 just after they have been formed within the charge electrode, the electric field present in the electrode between the walls of the slot 6 and the unbroken ink filament at the time of inducing the required charge on each charged droplet may also, at least in principle, undesirably deflect the intended path of the charged ink drops. This effect too may additionally and/or alternatively be reduced or eliminated in embodiments of the present invention, as it will be further explained below.

In addition, the elongated arrangement of charge electrodes according to embodiments of the present invention may make it simpler to induce the required charge on the droplets due to the capacitive coupling between the walls of the passage and the ink filament. For example, the prior art may require a distance of about 300 microns between the charge-inducing wall of the electrode and the ink filament, depending on the size of the ink jet which is determined, as it will be clear to the skilled person, by the size of the printing orifice. In embodiments of charge electrodes according to the invention said distance may be 375 microns or greater. This will be described further below in connection with FIG. 7 which shows an inlet aperture of 750 microns, ie twice the 375 microns. This in turn may reduce the electrode alignment requirements, or its susceptibility to electrostatic steerage, as it will further be described below.

Charge electrodes 2', 2'', 2''', 2'''' according to different embodiments of the invention are shown in FIGS. 3-7. These charge electrodes 2', 2'', 2''', 2'''' differ from those typical of the prior art in that they are examples of elongated coaxial charge electrodes capable of tunneling the ink filament on entry to the electrodes and the ink drops on exit therefrom, thereby screening the ink filament and/or the drops from any unwanted electric fields before the drops are formed, the moment they charge or while they are in flight through the electrodes. It will be understood that the term 'coaxial' as used in the present context refers to the ink jet and the ink drops being positioned at least partially on an axis of the charge electrode. This arrangement is different to that shown in FIGS. 1 and 2 since in FIGS. 1 and 2 the axis a of the charge electrode 2 does not coincide with the direction of travel of the ink jet and drops, this being instead generally perpendicular thereto and crossing the axis a at one intersection (not shown).

By providing elongated coaxial, or in some embodiments generally tubular, charge electrodes 2', 2'', 2''', 2'''', it is now possible to dispose the charge electrodes such that the ink filament and the ink drops when formed will now travel parallel to their axes a', a'', a''', a'''' rather than in a direction perpendicular thereto, as was the case with the prior art.

Accordingly, additional useful screening of the ink jet and/or the ink drops can now be obtained by extending the length of the charge electrodes 2', 2'', 2''', 2'''' in the direction that, in use, would be the direction of travel of the ink drops. Simultaneously, the coaxial capacitive coupling afforded by the coaxial configuration of these charge electrodes allows the charging walls of the slots/passages 6', 6'', 6''', 6'''' to be advantageously generally located at an increased distance from the ink filament. A small distance between such walls and the ink filament is usually required to induce an appropriate amount of charge on the ink filament. However, this may cause electrostatic steerage of the filament. An increased distance between the filament and said walls for a given amount of capacitive coupling may thus be beneficial, since any unwanted electrostatic steerage of the ink jet in the charge electrodes 2', 2'', 2''', 2'''' may then simultaneously be reduced or eliminated.

It should be noted that it would be of no or very limited benefit to extend the length of the charge electrode 2 of the prior art. This would have only have allowed the charge electrode 2 to provide added surface to capture the break-offs of the ink drops, but would have required an overall longer printhead 10 without providing or improving any shielding or screening of the charged droplets. This is clearly undesirable, especially when, as discussed above, phasing can be used to ensure that the ink drops are charged as and when required. The improved screening provided by embodiments of charge electrodes according to the present invention may instead turn this potential disadvantage of the prior art into a desired feature.

By providing an elongated coaxial design of charge electrodes 2', 2", 2''', 2'''' or, in some embodiments, generally tubular design of charge electrodes 2', 2", 2''', 2'''', the axial length of the electrodes 2', 2", 2''', 2" can usefully be increased to improve the shielding or screening effect of the tunnel crossed by the ink jet first and the traveling ink drops after these have detached from the ink jet inside the charge electrodes.

Simultaneously, the distance between the charging walls of the electrode and the ink jet may usefully be increased as discussed above.

A longer, generally coaxial or tubular electrode 2', 2", 2''', 2'''' will provide additional screening compared to a shorter electrode of the same type. Accordingly, the inventors have realised that it is now acceptable to provide an overall longer printhead 10' to accommodate any additional length (and the benefits associated with it) of the charge electrodes 2', 2", 2''', 2''''. Such increments in the length of the charge electrode may for example be 1 millimetre, or a subunit of that, for example one tenth or one hundredth of a millimetre. This is in contrast with the prior art shown in FIGS. 1 and 2, for which an additional length of charge electrode in the direction of travel of the drops would have merely represented a way of capturing additional lengths of drop break-offs as discussed above. This advantage may be preserved by embodiments of the present charge electrodes, but it would be ancillary with respect to the provision of improved screening. For this reason, it will be apparent that the charge electrodes 2', 2", 2''', 2'''' may also enable satisfactory phasing to be performed using less performant, and thus potentially less expensive, apparatus.

Figure 5:
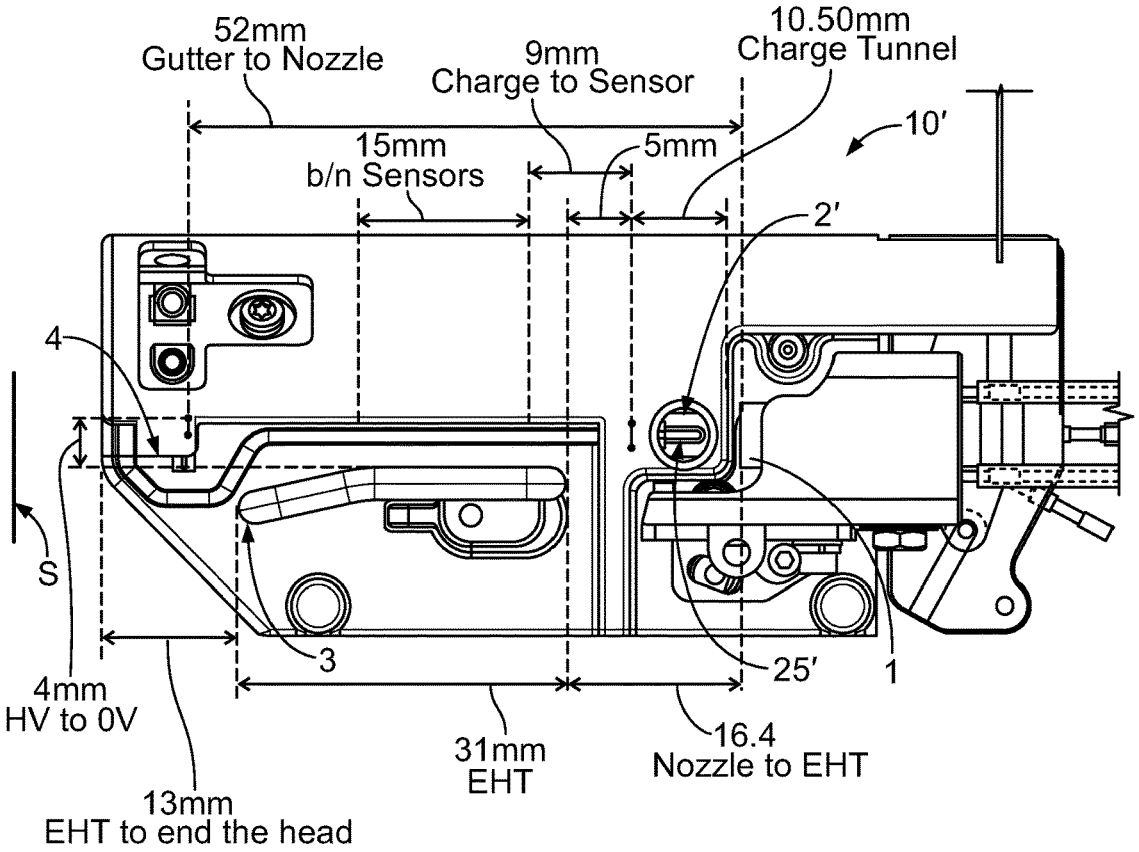
FIG. 5 is a top view of the deck of a continuous ink jet printhead according to an embodiment of the present invention, incorporating the charge electrode of FIGS. 3 and 4.

As shown in FIG. 5, which depicts a printhead 10' that mounts the charge electrode 2' shown in FIGS. 3 and 4, the distance between the nozzle 3 and the gutter 4 is 52 millimetres, while the distance between the nozzle 3 and the gutter 4 in the prior art printhead 10 shown in FIG. 2 is shorter, at 47.3 millimetres. The provision of a longer printhead is justified by the improved screening at the charge electrode.

With reference to FIGS. 3, 4 and 7, the first illustrated embodiment of charge electrode 2' defines a passage 6' for inducing a charge on the ink filament in ingress to the charge electrode 2' and thus for charging the ink droplets. The passage 6' extends along an axis a' that represents, in use, a travel axis of the ink droplets, and screens the ink jet and the charged droplets. As best shown in FIG. 7, the charge electrode 2' can be thought as it being divided into two distinct regions R1 and R2 at different axial locations along the electrode 2'.

The first axial region R1 is responsible for receiving and inducing a charge on the ink filament. This may only happen until the filament is broken into the individual ink drops. However, for simplicity and clarity of representation, the length of the region R1 in FIG. 7 is depicted as extending until the distal end of a viewing aperture 25' provided on the side of the electrode 2'. This will generally correspond to the maximum break-off distance, assuming that the overall system is designed for the break-off events to take place at locations within said viewing aperture. The first axial region R1 includes a cylindrical portion of the passage 6' of diameter 0.75 mm (this is twice the required capacitive distance between the passage's wall and the ink filament of 375 microns) which extends for the whole length of the region R1 which is 6.55 mm, as shown in FIG. 7. In this representation, therefore, the first axial region R1 extends up to and includes the electrode region in which the drop break-offs may be expected. It would alternatively be necessary to locate the drop break-off location and draw accordingly the distal boundary of region R1.

The second axial region R2 is responsible for screening the flight of any charged droplets while they transit through the electrode 2'. The minimum distance traveled by the charged droplets across the electrode 2' is the axial length of the region R2 of 3.95 mm depicted in FIG. 7 (this has been calculated as 10.50 mm corresponding to the overall length of the charge electrode minus 6.55 mm which is the length of the first axial region R1). The drops will however typically form at some location visible from the viewing aperture 25'. The charge electrode 2' therefore typically provides screening to the charged droplets for a distance in excess of the 3.95 mm shown in FIG. 7, for example for 5 mm, and the second axial region R2 would accordingly extend for this length. The second axial region R2 of the charge electrode 2' thus surrounds a segment of said travel axis a' so that, in use, the charged ink drops are tunneled and screened by the charge electrode 2' as they travel through it. The second axial region may thus be defined as an electrode region dedicated to exclusive transit of formed drops (ie the ink filament cannot reach said second region R2 by definition).

In the embodiment shown in FIGS. 3, 4 and 7, end sections 21', 22' of the charge electrode 2' fully surround corresponding portions of the electrode axis a' at 360° with respect to plans orthogonal to the electrode axis a'.

In the alternative embodiments 2", 2''', 2'''' shown in FIG. 6 at no location along the respective axes a", a''' a'''' do the charge electrodes 2", 2''' 2'''' fully surround any portion of the axes around a 360° angle with respect to plans orthogonal to these axes.

The charge electrode 2" of FIG. 6*a* comprises through-wall cut-away slits c1 and c2 extending part-way through the length L" of the electrode 2", from either edge of the electrode inwardly and parallel to the axis a" so as to overlap circumferentially for a length l".

The charge electrode 2''' depicted in FIG. 6*b* has a through-wall cut-away spiral c3 extending axially and circumferentially from one edge to the other of the charge electrode 2".

The charge electrode 2''' depicted in FIG. 6*c* has two through-wall cut-away slits c4 and c5 extending part-way through the length L'''' of the electrode 2'''' from either edge of the electrode inwardly and parallel to the axis a" so as to meet at keyhole aperture 25''''. A viewing aperture in the form of a keyhole aperture 25' is also present in the embodiment shown in FIGS. 3, 4 and 7 and will be described in further detail below.

With continued reference to FIGS. 3-7, the charge electrodes 2', 2", 2''', 2'''' consist of respective generally cylindrical bodies 7', 7", 7''', 7'''' with respective straight passages 6', 6", 6''', 6'''' for the ink filament and the ink drops.

The electrodes 2', 2"" shown in FIGS. 3, 4 and 6*c* are in addition provided with respective viewing apertures 25', 25"" for confirming the break-offs of the individual ink droplets and viewing the first instants of their flight through the electrodes 2', 2"". In these embodiments, the viewing apertures 25', 25"" are in the form of substantially rectangular keyhole apertures, with rounded edges in the case of the embodiment of FIGS. 3 and 4. These apertures that allow visual inspection of the drop formation by using stroboscopic light, as is known in the art. In the embodiments of FIGS. 3 and 4, it is the end section 22' that fully surrounds a portion of the axis a' and comprises the viewing aperture 25'.

FIG. 5 shows the charge electrode 2' of FIGS. 3, 4 and 7 and its keyhole aperture 25' in the context of the assembled printhead 10'. The keyhole aperture 25' has an elongated shape in the direction of the travel of the drops and defines two ends 23', 24' of the charge electrode 2' on either side of the keyhole aperture 25'. The first end 23' defines an inlet aperture 26' to the charge electrode 2' for the ink filament, while the second end 24' defines an outlet aperture 27' for the ink drops. In FIG. 5, the inlet aperture 26' is located on the right hand side of the keyhole aperture 25', adjacent the nozzle 1.

In the case of the charge electrode 2' of FIGS. 3, 4 and 7, the generally cylindrical body 7' has an outer stepped profile 28'. The outer stepped profile 28' defines a cylinder length in the form of a cylinder head 29' of increased diameter with respect to the rest of the cylindrical body 30'.

In this described embodiment, the inlet aperture 26' to the ink jet is provided on the cylinder head 29'. The inlet aperture 26' is smaller than the outlet aperture 27' and this may aid with the installation and positioning of the charge electrode 2' on the printhead deck 9' of the printhead 10' shown in FIG. 5. Unless the charge electrode has been accurately positioned, the ink jet will not be able to access and cross the passage 6' in the form of ink drops detached from the ink jet inside the electrode.

The passage 6' is also generally cylindrical and coaxial, in this embodiment, with the generally cylindrical body 7' of the charge electrode 2'. The passage 6' has an internally stepped profile. In this embodiment, said step (located at a distance of 6.55 mm from the inlet as shown in FIG. 7) divides and allows a viewer immediately to identify the first and second axial regions R1 and R2 shown in FIG. 7. The passage 6' has a first cross-section cs1 in connection with the cylinder head 29' and along the portion of the end section 22' comprising the viewing aperture 25'. The passage has a second and distinct cross section cs2 in connection with the second region R2.

In this described embodiment, the outlet aperture 27' is circular has a diameter (1.4 mm as shown in FIG. 7) which is approximately one third the outer diameter of the generally cylindrical body 7' at the distal end 24' (4 mm, as shown in FIG. 7). However, other geometries are possible and may vary greatly in detail.

The charge electrode 2' has a mounting and orientation feature 35' for mounting the charge electrode 2' on the printhead 10' shown in FIG. 5 such that the viewing aperture 25' is registered in the required position. In this described embodiment, the mounting and orientation feature is in the form of a flat 35' provided on the generally cylindrical body 7' of the charge electrode 2'. The flat 35' is provided on the outlet end 24' of the charge electrode 2' and extends part-way along the length L' of the generally cylindrical body 7', parallel to the axis a'. It will be understood, however, that other mounting and/or orientation features are also possible.

The length L' of the charge electrode 2' shown in FIGS. 3, 4 and 7 is 10.5 millimetres, and this can be appreciated with reference to the dimensions provided on FIGS. 5 and 7. Other lengths are however also possible.

The charge electrodes described herein are made of suitable conductive materials such as steel, as is known in the art, and will be provided with suitable connections to a conditioning amplifier and/or other control circuits. These however are not described herein.

The nozzle 1 described above is configured to emit the continuous ink jet from a 60 micron orifice at a velocity V equal to, in this case, about 20 m/s. Other velocities are however also possible, typically in the range between about 18 and 25 m/s. Alternative orifice widths are also possible, for example 40, 50 or 70 microns. It will be understood that these smaller orifices would require generally proportionally smaller electrodes, both in width and length, and that the larger orifice would require a proportionally larger electrode.

The printhead 10' described above is arranged to form the ink droplets at a frequency F equal to, in this case, 77 kHz. Other frequencies are however also possible, typically in the range between about 64 kHz to 128 kHz.

In the described embodiment of printhead 10', therefore, the ink droplets are accordingly generated at a droplet pitch DP=V/F equal to about 260 microns. The length L' of the electrode 2' can thus be expressed in terms of droplet pitch. The length L' of the charge electrode 2' shown in FIGS. 3 and 4 thus measures just above 40.3 droplet pitches. This accommodates wide variations of the location of drop formation along the ink jet. The possibility that the drops may form outside the charge electrode is therefore reduced. The (minimum) length of the second axial region R2 shown in FIG. 7 in terms of droplet pitches is just above 15 droplet pitches. This corresponds to about 4 drops per millimetre.

While specific embodiments of the invention have been described above, it will be appreciated that the invention may be practiced otherwise than as described herein. The description is not intended to limit the invention, whereas the invention is instead defined according to the scope of the appended claims.

The invention claimed is:

1. A charge electrode for continuous ink jet printers comprising:

a passage, defined by the charge electrode, for forming and shielding charged ink droplets, said passage extending along a travel axis that represents, in use, a position of an ink jet that enters the charge electrode and from which ink droplets detach inside the charge electrode, and a direction of travel of the ink droplets before they exit the charge electrode, wherein the charge electrode comprises directly abutting first and second axially sequentially disposed regions, wherein the first region is configured to induce a charge on ink droplets selected for printing by capacitive coupling, and the second region is configured to shield the charged ink droplets by surrounding at least a segment of said travel axis, wherein the charge electrode comprises an axial extension measuring 5 mm or longer.

2. The charge electrode of claim 1 , wherein the charge electrode comprises a cylindrical body defining a body cylinder axis parallel with said travel axis.

3. The charge electrode of claim 2, wherein said cylindrical body comprises an outer stepped profile defining a cylinder length of increased diameter with respect to a rest of the cylindrical body, wherein said first region comprises said cylinder length and wherein said second region comprises at least a portion of the rest of the cylindrical body.

4. The charge electrode of claim 2, wherein the second region comprises an outlet aperture for the ink droplets; wherein the outlet aperture is located opposite an inlet aperture; wherein a size of the inlet aperture is less than that of the outlet aperture.

5. The charge electrode of claim 2, wherein the charae electrode further comprises a viewing aperture for monitoring formation of the ink droplets;

wherein said viewing aperture is provided on a side of said cylindrical body.

6. The charge electrode of claim 5, wherein said viewing aperture comprises elongated shape that extends in the direction of travel and/or cylinder axes.

7. The charge electrode of claim 5, wherein the first and the second axially sequentially disposed regions are located one on either side of said viewing aperture.

8. The charge electrode of claim 5, wherein the first and second axially sequentially disposed regions define opposite ends of the charge electrode.

9. The charge electrode of claim 5, wherein the first and second axially sequentially disposed regions adjoin each other.

10. The charge electrode of claim 1, wherein said passage is cylindrical and defines a passage cylinder axis parallel with said travel axis.

11. The charge electrode of claim 10, wherein the charge electrode is a coaxial charge electrode and a cylinder axis of a cylindrical body of the charge electrode and/or the passage cylinder axis overlap with said travel axis, or one with the another.

12. The charge electrode of claim 1, wherein said first region comprises an inlet aperture for the ink jet.

13. The charge electrode of claim 1, wherein said passage comprises a step defining a stepped profile for the passage; wherein said step separates and/or identifies said first and second axially sequentially disposed regions;

wherein the passage is narrower in correspondence of the first region than the second region.

14. The charge electrode of claim 1, wherein the charge electrode comprises a mounting and/or orientation feature for mounting and/or registering in place, in use, the charge electrode on a printhead or a printhead deck.

15. The charge electrode of claim 14, wherein the mounting and/or orientation feature is in the form of a flat provided on the charge electrode; wherein said flat is provided on said second region.

16. The charge electrode of claim 1, wherein a length of the charge electrode is greater than 6 mm; or, greater than 7 mm; or, greater than 8 mm; or, greater than 9 mm; or, greater than 10 mm; wherein said lengths relate to said second region.

17. The charge electrode of claim 1, wherein the a length of said segment surrounded by said second region is 2 mm or longer.

18. The charge electrode of claim 1, wherein the charge electrode comprises an axially elongated shape.

19. The charge electrode of claim 1, wherein the first region is structured and/or configured to be different compared to the second region.

20. The charge electrode of claim 1, wherein the first region is better structured and/or configured to induce said charge on the charged ink droplets than the second region.

21. The charge electrode of claim 20, wherein the second region is better structured and/or configured to shield said charged ink droplets than the first region.

22. The charge electrode of claim 1, wherein the first region is configured to induce said charge on said ink droplets selected for printing for the ink droplets selected for printing to be deflected by one or more deflection plates for printing onto a moving substrate at predetermined positions.

23. Apparatus for a printhead comprising a charge electrode according to claim 1.

24. A printhead comprising:

a nozzle for generating a continuous ink jet and ink droplets detached therefrom;

a charge electrode as claimed in claim 1 or apparatus according to claim 23;

one or more deflection plates for deflecting the charged ink droplets charged by said charge electrode for printing on a moving substrate associated with the printhead; and a gutter for recirculating any uncharged ink droplets.

25. The printhead of claim 24, wherein the nozzle is configured to emit the continuous ink jet at a velocity V, the printhead is arranged to form the ink droplets at a frequency F, and the ink droplets are broken off from the continuous ink jet at a droplet pitch DP=V/F; and wherein a length of the charge electrode is greater than 15 droplet pitches.

26. The printhead of claim 25, wherein the length of the charge electrode is less than 70 droplet pitches.

27. An apparatus comprising the printhead as claimed in claim 24.

28. The apparatus of claim 27, wherein said apparatus is a continuous ink jet printer.

29. A method of printing, the method comprising:

generating a continuous ink jet;

forming a plurality of ink droplets from said continuous ink jet;

using a charge electrode as claimed in claim 1, selectively charging the ink droplets for printing on a moving substrate;

deflecting any charged ink droplets to print them on the moving substrate at predetermined positions.

* * * * *